US008821321B2

(12) United States Patent
Chiang

(10) Patent No.: US 8,821,321 B2
(45) Date of Patent: Sep. 2, 2014

(54) CLUB-SWING PRACTICE APPARATUS

(76) Inventor: Pin-Hui Chiang, Tokyo (JP)

( * ) Notice: Subject to any disclaimer, the term of this patent is extended or adjusted under 35 U.S.C. 154(b) by 2 days.

(21) Appl. No.: 13/607,884

(22) Filed: Sep. 10, 2012

(65) Prior Publication Data

US 2014/0038739 A1 Feb. 6, 2014

(30) Foreign Application Priority Data

Jul. 31, 2012 (TW) ..... 101127615 A

(51) Int. Cl.
*A63B 69/36* (2006.01)
*A63B 57/00* (2006.01)

(52) U.S. Cl.
USPC ..... 473/387; 473/257

(58) Field of Classification Search
USPC ..... 473/387–403, 257, 218, 219, 266, 268, 473/278; D21/717
See application file for complete search history.

(56) References Cited

U.S. PATENT DOCUMENTS

| | | | | | |
|---|---|---|---|---|---|
| 1,527,786 | A | * | 2/1925 | Cole, Sr. | 473/268 |
| 1,551,003 | A | * | 8/1925 | Fawcett | 473/394 |
| 2,096,055 | A | * | 10/1937 | Miller | 473/257 |
| 2,121,113 | A | * | 6/1938 | Stewart | 473/257 |
| 2,165,479 | A | * | 7/1939 | Hallberg | 473/257 |
| D152,218 | S | * | 12/1948 | Reifman | D21/718 |
| 2,862,714 | A | * | 12/1958 | Smith | 473/257 |
| 3,325,168 | A | * | 6/1967 | Fyanes | 473/235 |
| 3,347,551 | A | * | 10/1967 | Dreyfus | 473/257 |
| 3,448,984 | A | * | 6/1969 | Dreyfus | 473/257 |
| 3,675,929 | A | * | 7/1972 | Guarino, Sr. | 473/257 |
| 3,883,144 | A | * | 5/1975 | Lazow | 473/218 |
| 4,544,159 | A | * | 10/1985 | Sells | 473/218 |
| 4,669,725 | A | * | 6/1987 | Taylor | 473/257 |
| 5,437,448 | A | * | 8/1995 | Balson | 473/257 |
| 6,056,651 | A | * | 5/2000 | Malinoff | 473/400 |
| D434,817 | S | * | 12/2000 | Cole, Jr. | D21/718 |
| 6,659,775 | B1 | * | 12/2003 | Moy | 434/252 |
| D490,133 | S | * | 5/2004 | Hadala | D21/791 |
| 6,769,999 | B1 | * | 8/2004 | Chase | 473/386 |
| D543,597 | S | * | 5/2007 | Lee et al. | D21/718 |
| 2005/0009645 | A1 | * | 1/2005 | Isabell | 473/400 |
| 2005/0075186 | A1 | | 4/2005 | Liao | |
| 2005/0233837 | A1 | * | 10/2005 | Jung | 473/386 |
| 2006/0166765 | A1 | * | 7/2006 | Holtzman | 473/387 |
| 2006/0258483 | A1 | * | 11/2006 | Hannah et al. | 473/387 |
| 2009/0124406 | A1 | * | 5/2009 | Alter | 473/218 |
| 2010/0130311 | A1 | * | 5/2010 | Tapia | 473/409 |
| 2013/0012332 | A1 | * | 1/2013 | Leyva | 473/266 |
| 2013/0190101 | A1 | * | 7/2013 | Mabrey | 473/257 |

FOREIGN PATENT DOCUMENTS

| | | |
|---|---|---|
| TW | M247246 U | 10/2004 |
| TW | M386100 | 8/2010 |

* cited by examiner

*Primary Examiner* — Steven Wong
(74) *Attorney, Agent, or Firm* — Alan Kamrath; Kamrath IP Lawfirm, P.A.

(57) ABSTRACT

A club-swing practice apparatus includes a tee and a bar assembled to the tee. The tee has a positioning portion and a ball supporter. The bar is assembled to the tee and has a coupling portion capable of being coupled with the ball supporter.

9 Claims, 5 Drawing Sheets

CLUB-SWING PRACTICE APPARATUS

BACKGROUND OF THE INVENTION

1. Field of the Invention

The present invention generally relates to a club-swing practice apparatus and, more particularly, to a club-swing practice apparatus that helps a user determine the proper timing needed when hitting a ball, thereby improving the shot accuracy.

2. Description of the Related Art

Golf has long been a popular sport in modern society. When playing golf, a golf rubber tee 9 (as shown in FIG. 1) must be used to support a golf ball 8. In this regard, under the golf player's personal skill and the coach's instructions, the golf player will make fine adjustments to his/her position during the entire swing process of the golf club, trying to successfully hit the golf ball 8.

However, it requires both correct positioning and adept skills to play golf. When the player's positioning is not correct enough or the player is not skillful enough, the golf club can divert from the proper movement path that the golf club is supposed to travel along. As a result, the golf club cannot make contact with the golf ball 8 with the accuracy and force necessary to complete a successful golf swing. An improper golf swing or contact may even result in missing the golf ball 8 completely.

When playing golf, the head of the golf club is required to travel along a predetermined path during a series of continuous motions such as a "back swing", a "down swing", "the point of contact with the golf ball" and a "follow through". This must be completed in a correct fashion in order to powerfully and accurately hit the golf ball in the desired direction. In light of this, Taiwan Patent Nos. I223603, M247246 and M386100 disclose a variety of golf practice apparatuses that can be used by a golf beginner to practice swinging the golf club with the correct positioning as well as to practice hitting the golf balls.

During the use of the conventional golf practice apparatus mentioned above, the golf beginners still need someone to adjust their positioning. It can be difficult for golf beginners to adjust their position without a coach or expert on hand to help them. This can result in frustration in the learning process of a golf swing. In addition, if said apparatus is not properly used, the users' position is not effectively adjusted. In a worse case scenario, golf beginners may even be injured due to incorrect positioning.

In light of this, it is necessary to provide a club-swing practice apparatus that helps a user to determine the proper timing needed when hitting the ball, so that the accuracy in hitting the ball can be improved. This aids the user in the learning process of the sport while practicing to omit the above problems.

SUMMARY OF THE INVENTION

It is therefore the objective of this invention to provide a club-swing practice apparatus which helps a user recognize the timing needed in properly hitting the ball. Based on the determined timing, the user is able to recognize which point of the club head face should be used for aiming. This improves the user's understanding in hitting the ball and allows the user to hit the ball with sufficient force and accuracy.

It is another objective of this invention to provide a club-swing club alignment apparatus that can be used by a user to practice swinging the club and to adjust his/her position without someone on hand to help them, thus reducing the potential of injury resulting from incorrect positioning.

In one embodiment, a club-swing practice apparatus includes a tee and a bar assembled to the tee. The tee has a positioning portion and a ball supporter. The bar is assembled to the tee and has a coupling portion capable of being coupled with the ball supporter.

In a preferred form shown, two opposing insertion openings are arranged on an outer circumferential face of the ball supporter. The bar is inserted through the two insertion openings. The coupling portion of the bar is inserted into and positioned in the ball supporter.

In the preferred form shown, the coupling portion has a protruding face and a concave face opposite to the protruding face. The protruding face faces the positioning portion, and the concave face faces away from the positioning portion.

In the preferred form shown, the coupling portion is positioned at a center of the bar and is in the form of a through-hole. The bar is fitted around the ball supporter via the through-hole.

In the preferred form shown, the positioning portion of the tee includes a base, and the ball supporter is in the form of a shaft. The shaft is integrally formed with the base, and the shaft is in the form of a tube made of rubber or plastic.

In the preferred form shown, a ball recess is formed on a top of the ball supporter, and the ball recess includes an inclined bottom face.

In the preferred form shown, the bar is positioned at one end of the ball supporter where the ball recess is. In addition, the bar is spaced from the positioning portion.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
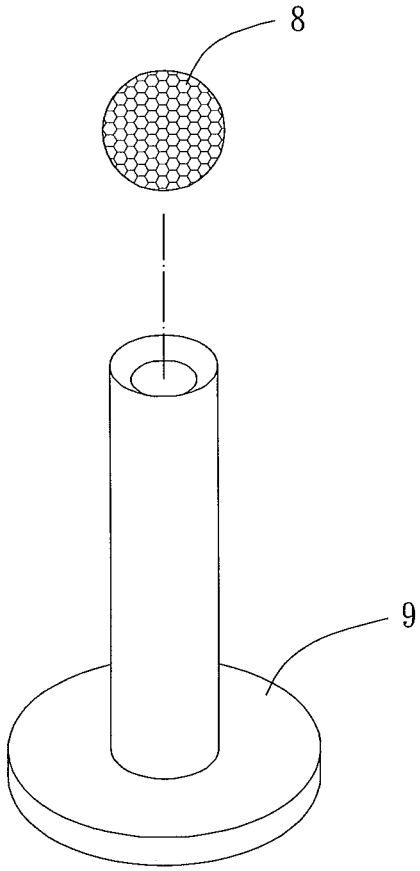
FIG. 1 PRIOR ART
FIG. 1 shows a golf rubber tee and a golf ball.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

A club-swing practice apparatus is disclosed according to preferred embodiments of the invention. The club-swing practice apparatus can be used in sports where users are required to visually focus on the ball in order to successfully hit the ball with the right timing, such as golf, croquet, etc. In the embodiment shown, golf is exemplarily used as the sport for illustration of the invention, as elaborated below.

Figure 2:
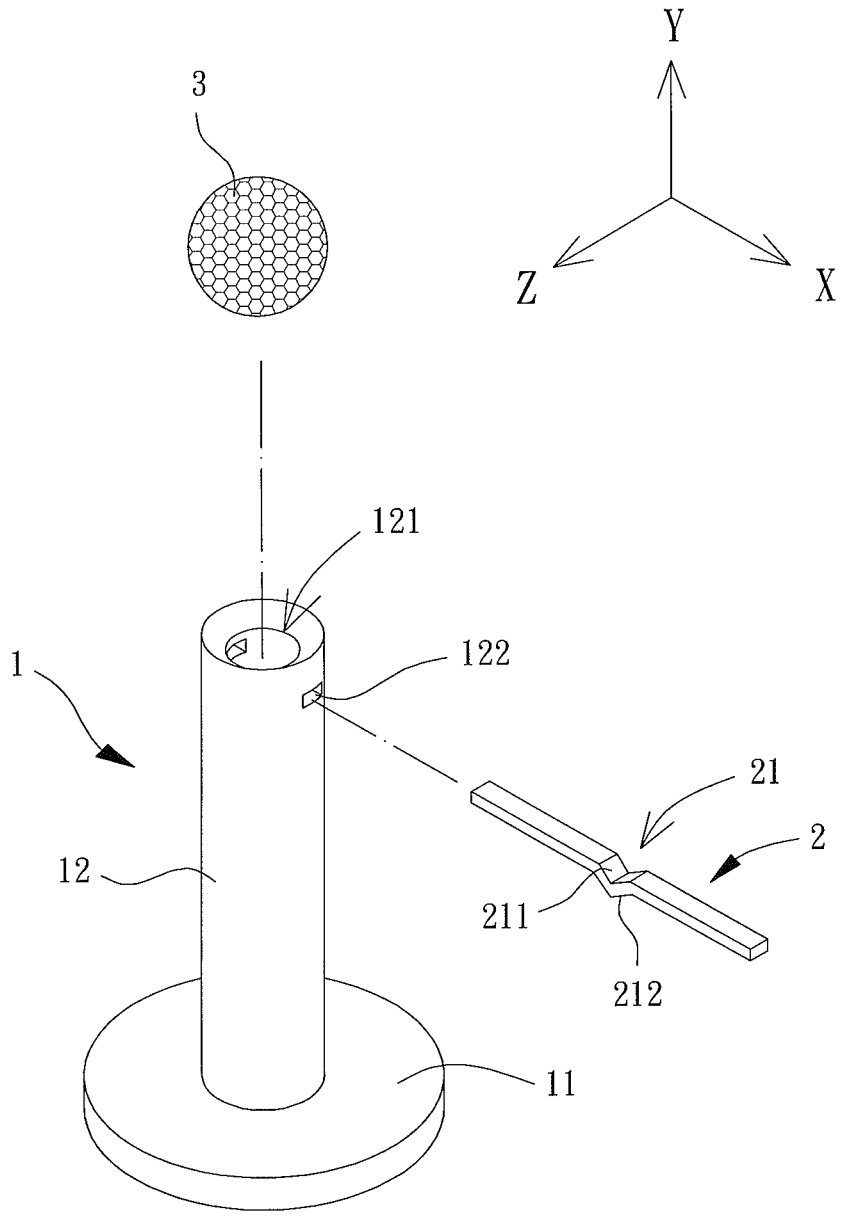
FIG. 2 is an exploded view of a club-swing practice apparatus according to a preferred embodiment of the invention.

Referring to FIG. 2, the club-swing practice apparatus includes a tee 1 and a bar 2 assembled to the tee 1.

The tee 1 is a rubber tee that is commonly adapted to support a ball 3. The tee 1 has a positioning portion 11 and a ball supporter 12. The tee 1 is positioned by the positioning portion 11. The ball supporter 12 is adapted to support the ball 3. The tee 1 may be in the form of a shaft having a first end and a second end. The ball supporter 12 may be positioned at the first end of the shaft, and the positioning portion 11 is positioned at the second end of the shaft. The positioning portion 11 may be positioned on the ground to prevent undesired shift of the tee 1 as well as supporting the ball 3. Alternatively, positioning portion 11 of tee 1 may include a base, and the ball supporter 12 may be in the form of a shaft. The shaft may be integrally formed with the base. Alternatively, the shaft may also be coupled with the base by way of adhesion, press fit or the like. Specifically, the shaft is in the form of a tube made of elastic material such as rubber, plastic or the like, to reduce the impact acted upon the ball supporter 12 when the head 4 of the golf club hits the ball supporter 12. This also prevents damage to the golf club resulting from the golf club hitting a rigid material.

In this embodiment, a ball recess 121 is formed on the top of the ball supporter 12 (shaft) for receiving the ball 3. The ball recess 121 includes an inclined bottom face as shown in FIG. 2. The inclined bottom face extends downwards from an outer circumferential face of the ball supporter 12 towards a center of the ball supporter 12. The inclined bottom face provides a ball-guiding function which allows the ball 3 to be smoothly hit out of the ball recess 121 at the moment the golf club hits the ball 3.

Referring to FIGS. 2 and 3 again, the bar 2 has a coupling portion 21 that can be coupled with the ball supporter 12.

Two opposing insertion openings 122 are arranged on the outer circumferential face of the ball supporter 12. The bar 2 is inserted through the two opposing insertion openings 122. The insertion openings 122 are preferably close to the ball recess 121 to allow the coupling portion 21 of the bar 2 to be inserted into and positioned in the ball supporter 12 via one of the insertion openings 122. The coupling portion 21 may be formed at the center of the bar 2 as shown in FIG. 2. After assembly, the bar 2 is preferably close to the ball recess 121 of the ball supporter 12 and spaced from the positioning portion 11 by a distance for noticeable indication. Moreover, the coupling portion 21 has a protruding face 212 and a concave face 211. The protruding face 212 faces the positioning portion 11. The concave face 211 faces away from the positioning portion 11. Specifically, the concave face 211 faces the ball recess 121. The bar 2 may be partially fixed in the ball supporter 12 by engaging the protruding face 212 in the ball supporter 12. The ball 3 is stably positioned on the ball recess 121 via the concave face 211.

Figure 6:
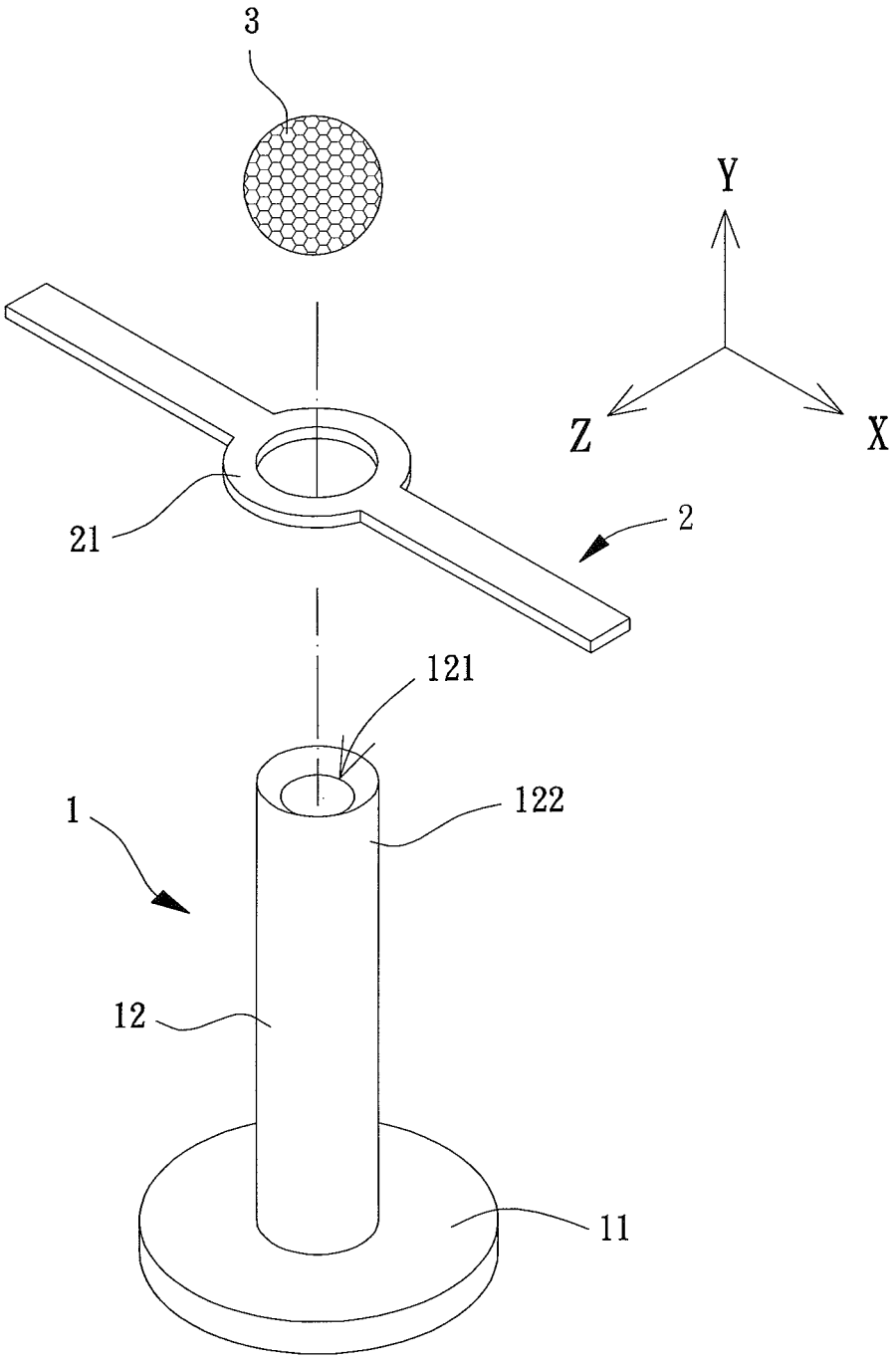
FIG. 6 is an exploded view of a modified club-swing practice apparatus according to the preferred embodiment of the invention.

The coupling portion 21 may be in the form of a through-hole as shown in FIG. 6, so that the bar 2 can be fitted around the ball supporter 12 via the through-hole. The through-hole can be in any size that allows the bar 2 to be securely fixed around and engaged with the ball supporter 12 by way of press fit, adhesion, screwing, welding or the like. Thus, the through-hole is not described herein in detail.

Figure 3:
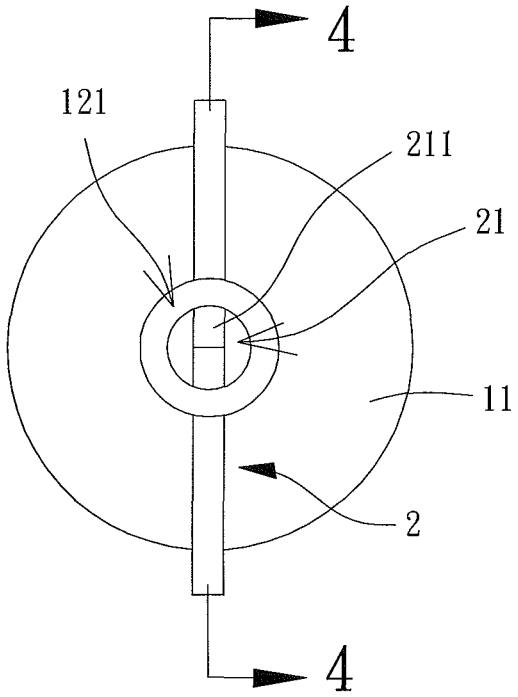
FIG. 3 is a top view of the club-swing practice apparatus of the preferred embodiment of the invention.

In the above description, the bar 2 is exemplarily shown to couple with the tee 1 by way of insertion (as shown in FIGS. 2 and 3) and press fit (as shown in FIG. 6) such that the bar 2 is securely fixed on the tee 1 in a direction X. However, the bar 2 may be coupled with the tee 1 in other manners (such as adhesion, screwing, welding or the like) to achieve the same purpose.

Figure 4:
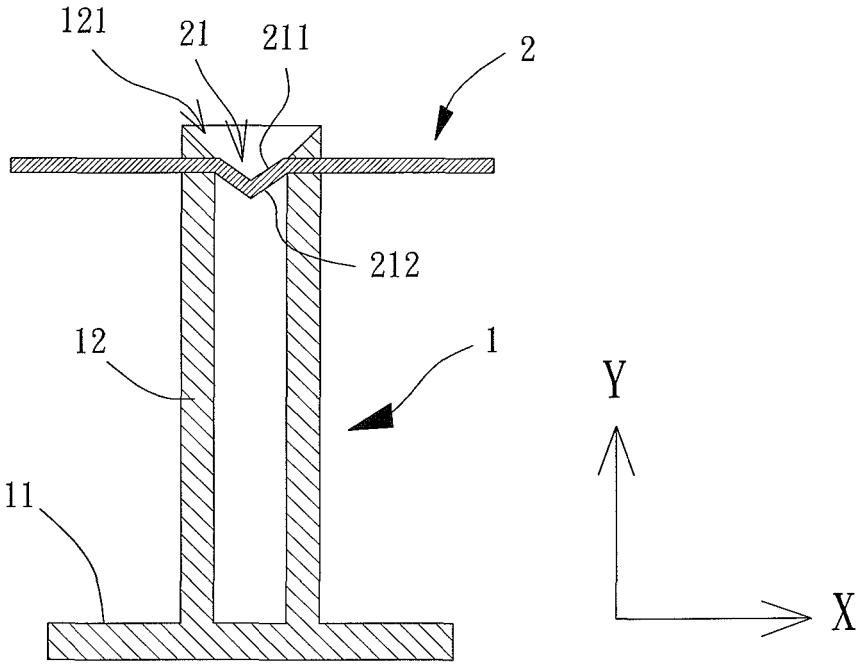
FIG. 4 is a cross-sectional view of the club-swing practice apparatus according to the preferred embodiment of the invention.
Figure 5:
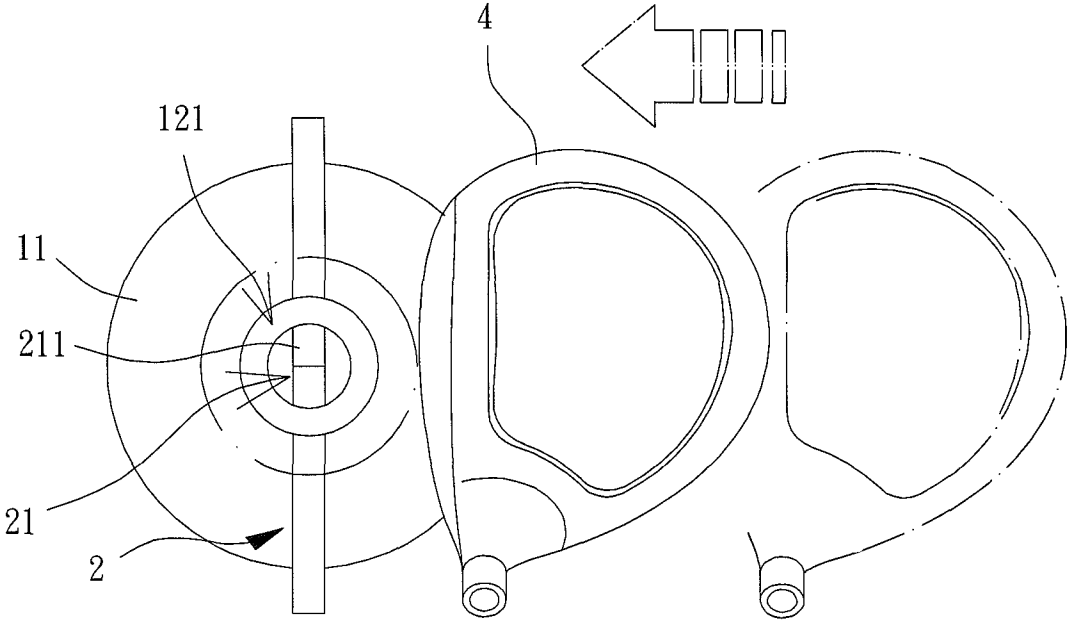
FIG. 5 is a use of the club-swing practice apparatus of the preferred embodiment of the invention.

Referring to FIGS. 4 and 5, after the tee 1 and the bar 2 are assembled to each other as shown in FIG. 4, a user is required to place the ball 3 on the ball recess 121 and then to swing the club in a direction as indicated by the arrow shown in FIG. 5. Based on this, when the user initially focuses on the bar 2 as the user swings the club, the user may prepare to hit the ball 3. Thus, by the time the user's attention is fully focused in the area of the bar 2 as the club head 4 enters the vicinity of the bar 2, the club head 4 may smoothly hit the ball 3 out of the ball recess 121 when the club head 4 makes contact with the ball 3.

In conclusion, the bar 2 is provided as an obvious indication in which a virtual circular range may be extended from the ball recess 121 based on the size of the bar 2. The virtual circular range serves as the user's visual reference for the user to judge the timing when hitting the ball. Namely, the virtual circular range provides a visual reference for the user to judge the timing in hitting the ball 3. When the user's line of sight is transferred to the virtual circular range as the user swings the club, the user is able to judge the proper timing in hitting the ball 3. Based on the determined timing, the user may recognize when he/she needs to bring the club up to successfully hit the ball 3. This improves the user's ability to determine the timing in hitting the ball 3. Based on the improved timing control, the club head 4 hits the ball 3 with sufficient power and accuracy, thereby hitting the ball 3 a farther distance and improving the accuracy of the shot. Moreover, since the bar 2 can be easily assembled to the tee 1, the users are able to use the club-swing practice apparatus alone and without anyone's help. The users are also able to adjust the bar 2 in a proper position that fits to their figures, improving the gesture accuracy and reducing the potential of injury resulting from incorrect gestures.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A club-swing practice apparatus comprising:

a tee having a positioning portion and a ball supporter, with the ball supporter being in a form of a tube including an inner periphery and an outer periphery; and a bar assembled to the tee, wherein the bar has a coupling portion coupled with the ball supporter, wherein two opposing insertion openings extend between the inner and outer peripheries of the ball supporter, wherein the bar is inserted through the two opposing insertion openings, and wherein the coupling portion of the bar is inserted into and positioned in the inner periphery of the ball supporter, wherein the coupling portion has a protruding face and a concave face opposite to the protruding face, with the concave and protruding faces each having an annular periphery conforming to the inner periphery of the ball supporter, wherein the protruding face faces the positioning portion, and wherein the concave face faces away from the positioning portion.

2. The club-swing practice apparatus as claimed in claim 1, wherein the positioning portion of the tee includes a base, wherein the ball supporter is in the form of a shaft, wherein the shaft is integrally formed with the base, and wherein the shaft is in the form of the tube made of rubber or plastic.

3. The club-swing practice apparatus as claimed in claim 1, wherein a ball recess is formed on a top of the ball supporter, and wherein the ball recess includes an inclined bottom face.

4. The club-swing practice apparatus as claimed in claim 3, wherein the bar is positioned at one end of the ball supporter where the ball recess is, and wherein the bar is spaced from the positioning portion.

5. The club-swing practice apparatus as claimed in claim 1, wherein the two opposing insertion openings and the bar have rectangular cross-sectional shapes.

6. The club-swing practice apparatus as claimed in claim 5, wherein the protruding face has an outer end in firm engagement with the inner periphery of the ball supporter.

7. The club-swing practice apparatus as claimed in claim 5, wherein the positioning portion of the tee includes a base, wherein the ball supporter is in the form of a shaft, wherein the shaft is integrally formed with the base, and wherein the shaft is in the form of the tube made of rubber or plastic.

8. The club-swing practice apparatus as claimed in claim 7, wherein a ball recess is formed on a top of the ball supporter, and wherein the ball recess includes an inclined bottom face.

9. The club-swing practice apparatus as claimed in claim 8, wherein the bar is positioned at one end of the ball supporter where the ball recess is, and wherein the bar is spaced from the positioning portion.

* * * * *